US011807500B2

(12) United States Patent
Kultanen

(10) Patent No.: US 11,807,500 B2
(45) Date of Patent: Nov. 7, 2023

(54) HOISTING DEVICE

(71) Applicant: KONECRANES GLOBAL CORPORATION, Hyvinkää (FI)

(72) Inventor: Tero Kultanen, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 776 days.

(21) Appl. No.: 16/964,405

(22) PCT Filed: Jan. 25, 2019

(86) PCT No.: PCT/FI2019/050060
§ 371 (c)(1),
(2) Date: Jul. 23, 2020

(87) PCT Pub. No.: WO2019/145610
PCT Pub. Date: Aug. 1, 2019

(65) Prior Publication Data

US 2021/0047150 A1 Feb. 18, 2021

(30) Foreign Application Priority Data

Jan. 26, 2018 (FI) ..... 20185072

(51) Int. Cl.
*B66C 13/00* (2006.01)
*B66C 13/06* (2006.01)
*B66C 11/04* (2006.01)

(52) U.S. Cl.
CPC ..... *B66C 13/06* (2013.01); *B66C 11/04* (2013.01)

(58) Field of Classification Search
CPC ..... B66C 13/04; B66C 13/06; B66C 13/063; B66C 13/08; B66C 13/44; B66C 15/04; H02G 11/00; B65G 1/026; B65G 1/10
See application file for complete search history.

(56) References Cited

U.S. PATENT DOCUMENTS

2005/0079041 A1* 4/2005 Campbell ..... H01L 21/6773 414/626
2008/0315167 A1* 12/2008 Takeuchi ..... B66F 3/06 254/358

(Continued)

FOREIGN PATENT DOCUMENTS

CN 103742882 A * 4/2014
CN 107014631 A * 8/2017 ..... B63B 9/00

(Continued)

OTHER PUBLICATIONS

International Preliminary Report on Patentability, issued in PCT/FI2019/050060, dated Mar. 12, 2020.

(Continued)

*Primary Examiner* — Emmanuel M Marcelo

(74) *Attorney, Agent, or Firm* — Birch, Stewart, Kolasch & Birch, LLP

(57) ABSTRACT

A hoisting device includes a first part movably connected to a running rail above it, and a second part suspended under the first part, and a hoist arranged between the first part and second part to lift and lower the second part. In addition, a scissors mechanism is arranged between the first part and second part to prevent the horizontal movement and twisting movement of the second part in relation to the first part. Such a hoisting device is advantageous, because the second part of the hoisting device may be lifted and lowered at the same time as the first part is moved without any notable swinging exerted on the second part.

6 Claims, 2 Drawing Sheets

(56) References Cited

U.S. PATENT DOCUMENTS

| | | | | |
|---|---|---|---|---|
| 2013/0220959 | A1* | 8/2013 | Won | H01L 21/68707 254/266 |
| 2018/0208444 | A1* | 7/2018 | Kultanen | H02G 11/006 |

FOREIGN PATENT DOCUMENTS

| | | | | | |
|---|---|---|---|---|---|
| CN | 210368742 | U | * | 4/2020 | |
| CN | 113233310 | A | * | 8/2021 | B66C 1/12 |
| DE | 196 43 347 | A1 | | 4/1998 | |
| GB | 710334 | | | 6/1954 | |
| GB | 1 531 593 | | | 11/1978 | |
| JP | 58-42590 | A | | 3/1983 | |
| JP | 58-52185 | A | | 3/1983 | |
| JP | 4-32403 | A | | 2/1992 | |
| JP | 7-10459 | A | | 1/1995 | |
| JP | 10-88992 | A | | 4/1998 | |
| JP | 2001-146303 | A | | 5/2001 | |

OTHER PUBLICATIONS

International Search Report, issued in PCT/FI2019/050060, dated Apr. 15, 2019.
Written Opinion of the International Searching Authority, issued in PCT/FI2019/050060, dated Apr. 15, 2019.

* cited by examiner

HOISTING DEVICE

FIELD OF THE INVENTION

The present invention relates to hoisting devices.

DESCRIPTION OF THE PRIOR ART

It is previously known to use a hoisting device which comprises a top part movably fixed to a ceiling, and a bottom part suspended under it, as well as flexible hoisting means arranged between the top and bottom parts to lift and lower the bottom part.

A problem with such a hoisting device is that its bottom part is susceptible to swinging when the hoisting device in question is driven while the bottom part is down, in which case the bottom part is subject to a force of opposite direction in relation to the movement direction of the top part, and possibly twisting force around the height axis of the hoisting device.

Another known solution is to use a hoisting device which has a pillar body and which is arranged to travel on rails on the floor and ceiling. However, such a hoisting device is often massive and, due to the floor rail, its use is limited to a space that has no underpasses, for example.

SUMMARY OF THE INVENTION

An object of the invention is thus to provide a device by means of which at least part of the aforementioned problems may be solved. The object of the invention is achieved with a device which is characterised by what is disclosed is the independent claim. Preferred embodiments of the invention are disclosed in the dependent claims.

The above goal is reached by a hoisting device which comprises a first part movably connected to a running rail, and a second part suspended under the first part. In addition, the hoisting device comprises hoisting means arranged between the first part and second part to lift and lower the second part, as well as a scissors mechanism arranged between the first and second part to prevent the horizontal movement and twisting movement of the second part in relation to the first part.

BRIEF DESCRIPTION OF THE DRAWINGS

The invention will now be described in closer detail in connection with the preferred embodiments, with reference to the accompanying drawings in which.

DESCRIPTION OF AT LEAST ONE EMBODIMENT

Figure 1:
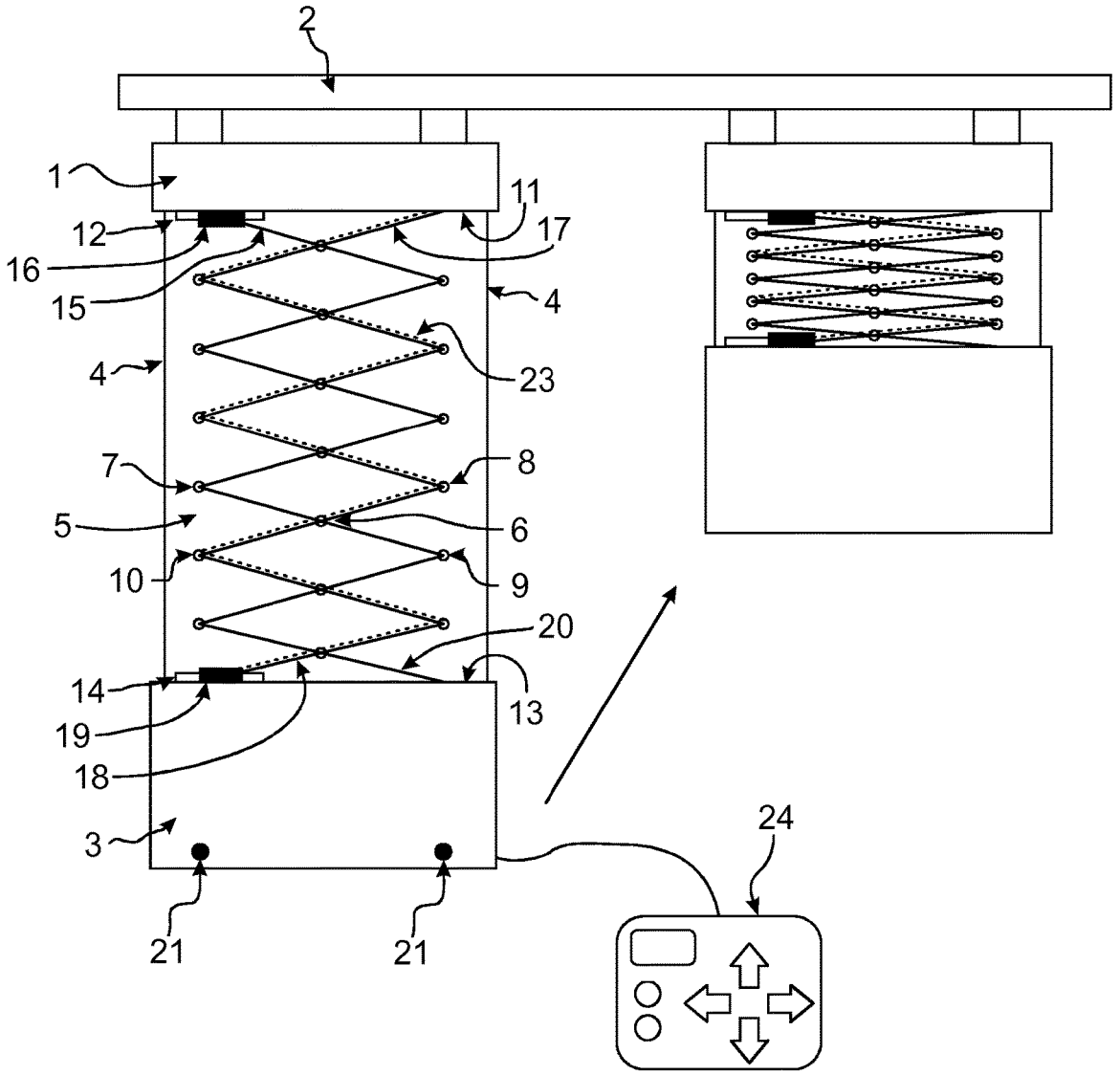
FIG. 1 shows a first embodiment of the hoisting device.

FIG. 1 shows, by way of example, an overall view of the first embodiment of the hoisting device. With reference to FIG. 1, the embodiment in question comprises a first part 1 movably fixed to a running rail 2 located above the first part 1. It is advantageous to fix a hoisting device exclusively to an overhead rail, because it allows the hoisting device to be used without a bottom rail in a storage, for example, having underpasses. Said hoisting device further comprises a second part 3 which is suspended under the first part 1, and hoisting means 4 arranged between the first part 1 and second part 3 to lift and lower the second part 3. Said second part 3 may be, for example, a cage open on two sides, where a load may be placed through its open sides. In addition, between the first part 1 and second part 3 there is arranged a scissors mechanism 5 to prevent the horizontal movement of the second part 3 in relation to the first part 1.

Said hoisting means 4 may comprise at least one flexible rope, which is strung between the first part and the second part so that it fastens to the second part at four fastening points to lift and lower the second part 3. Said flexible rope may also be a strap or cable, for example. Alternatively, the hoisting means 4 may comprise, for example, four or more ropes, each of which is connected to the second part 3 each at its own fastening point.

Said scissors mechanism 5 comprises a plurality of beam pairs. At the centre of at least one beam pair there is a first joint 6 rotatably connecting the beams, and to the first end, second end, third end, and fourth end of said at least one beam pair, a second joint 7, third joint 8, fourth joint 9, and fifth joint 10 have been correspondingly arranged. Said joints 7 to 10 rotatably connect said at least one beam pair to the previous and subsequent beam pair. Said joints 6 to 10 are advantageously implemented by using bearings.

In the embodiment shown in FIG. 1, in order to fasten said scissors mechanism 5 to the hoisting device, there is arranged on a second surface 11 (bottom surface in the drawings) of the first part 1, a first running rail 12, and on a first surface 13 (top surface in the drawings) of the second part 3, there is arranged a second running rail 14. A first end part 15 of the scissors mechanism 5 is slidably fixed to the first running rail 12 by a first runner block 16, and a second end part 17 of the scissors mechanism 5 is rotatably fixed to the second surface 11 of said first part 1. Correspondingly, a third end part 18 of the scissors mechanism 5 is slidably fixed to the second running rail 14 by a second runner block 19, and a fourth end part 20 of the scissors mechanism 5 is rotatably fixed to the first surface 13 of said second part 3.

Said scissors mechanism 5 is advantageous, because it stiffens the structure of the hoisting device and seeks to keep the second part 3 parallel to the first part 1, and thus to reduce the horizontal swinging and rotating swinging acting on the second part 3. Due to the scissors mechanism 5, the second part 3 of the hoisting device may be lifted at the same time as the first part 1 of the hoisting device is moved in the lateral direction without any notable swinging exerted on the second part 3. The simultaneous lifting and lateral movement described in the above is shown in FIG. 1 by way of example. Simultaneous lifting and lateral movement significantly speed up the moving of the hoisting device from one place to the next. In addition, the reduced swinging reduces the risk of the hoisting device hitting the surroundings and makes it easier to align the second part 3 of the hoisting device in the right place in relation to, for example, a storage shelf.

Figure 2:
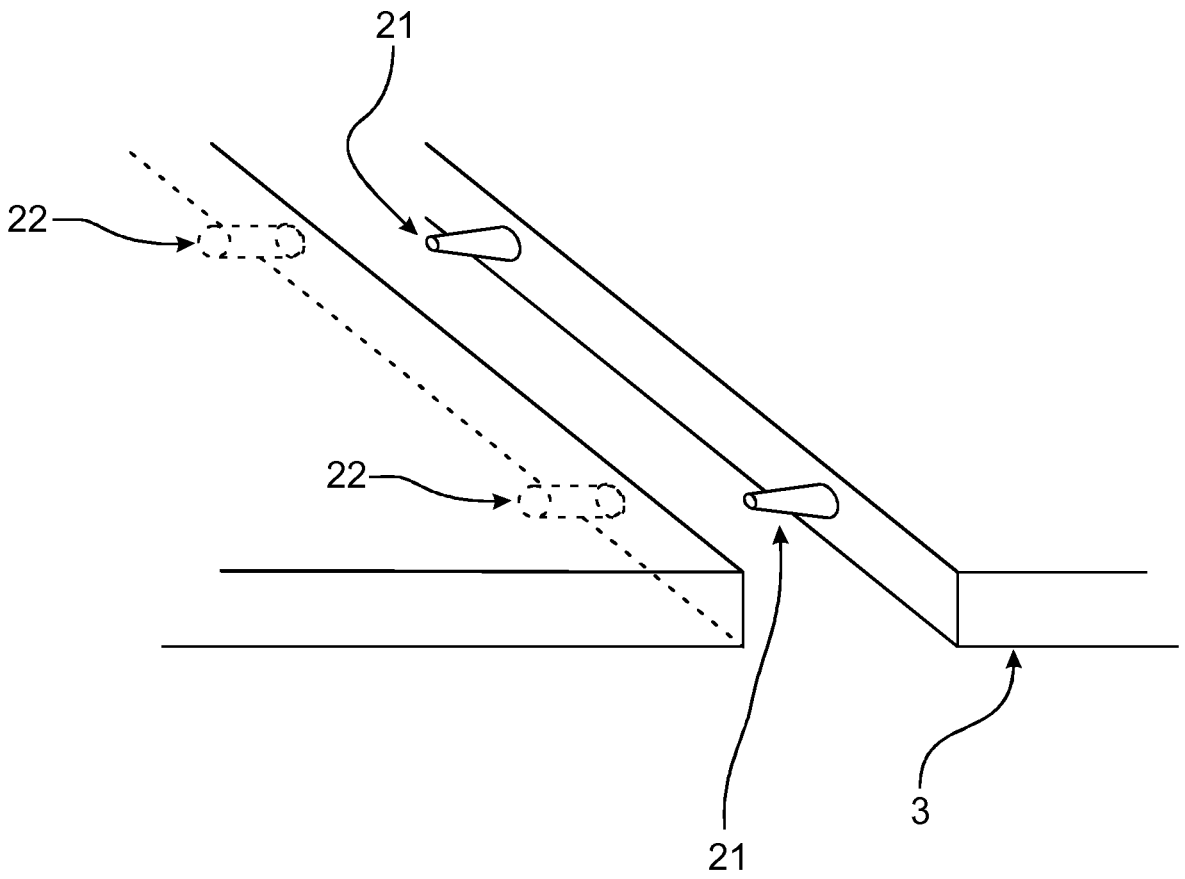
FIG. 2 shows an enlarged conceptual view of aligning the second part of the hoisting device according to the first embodiment in the correct place in relation to a shelf.

FIG. 2 shows an enlarged conceptual view of aligning the second part 3 of the hoisting device according to the first embodiment in the correct place in relation to a shelf. Said second part 3 may comprise one or more aligning members 21 to align the second part of the hoisting device in the correct place in relation to a storage shelf. FIG. 2 shows, by way of example, that the aligning members in question may be, for example, pins protruding from the second part, making con-tact with a counterpart 22 located on the storage shelf. Said protruding pins or their counterparts may advantageously be shaped conical to facilitate the alignment. In FIG. 2, said protruding pins are shown in an at least partially protruded position. As the hoisting device is moving, the protruding pins are located inside the bottom part of the hoisting device, and as the hoisting device stops in the vicinity of the correct shelf position, said pins protrude outwards in order to align the second part of the hoisting device in the correct place in relation to a storage shelf.

Alternatively, the aligning members may be electrical or optical sensors, for example. For the aligning members to work, at least one electrical wire 23 (shown by dotted lines in FIG. 1) is arranged between the first part 1 and the second part 3. Said at least one electrical wire 23 is advantageously fastened to the scissors mechanism 5 to surround said scissors mechanism 5.

FIG. 1 also shows, by way of example, an alternative for controlling the hoisting device. In the example in question, the hoisting device comprises a control device 24 connected to the hoisting device and further comprising a user interface, and by means of which the hoisting device may be manually controlled when it is in a manual control mode. The user interface on the control device may comprise, for example, push buttons which, when pressed, send signals to the hoisting device to control an electrical motor that makes said hoisting device move.

Alternatively, the hoisting device may be controlled in an automatic control mode. In such a case, the hoisting device comprises a computer, separate from it, which reads a computer program or input entered by a user, and based on them sends signals to the hoisting device to control the electrical motor that makes the hoisting device in question move. The hoisting device may further comprise a second transmitter which in both the manual and automatic control modes sends information received from the aligning members back to the control device or computer.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. A hoisting device comprising:

a first part movably connected to a running rail;

a second part suspended under the first part;

a hoist arranged between the first part and second part to lift and lower the second part;

a scissors mechanism arranged between the first part and second part to prevent horizontal movement and twisting movement of the second part in relation to the first part; and one or more aligning members to align the second part in the correct place in relation to a shelf, wherein said one or more aligning members comprise one or more protruding pins located at a bottom part of the hoisting device that orient themselves in counterparts of the shelf to align the second part in the correct place in relation to the shelf.

2. The hoisting device as claimed in claim 1, wherein said hoist comprises at least one flexible rope fixed to the second part at four fastening points to lift and lower the second part.

3. The hoisting device as claimed in claim 1, wherein said scissors mechanism comprises a plurality of beam pairs, at the centre of at least one beam pair there being a first joint connecting the beams, and to a first end, a second end, a third end, and a fourth end of said at least one beam pair, a second joint, a third joint, a fourth joint, and a fifth joint are arranged, which joints rotatably connect said at least one beam pair to the previous and subsequent beam pair.

4. The hoisting device as claimed in claim 3, wherein a first running rail is arranged on a second surface of the first part, and a second running rail is arranged on a first surface of the second part.

5. The hoisting device as claimed in claim 4, wherein a first end part of said scissors mechanism is slidably fixed to the first running rail by a first runner block, and a second end part of the scissors mechanism is rotatably fixed to the second surface of said first part, and wherein a third end part of said scissors mechanism is slidably fixed to the second running rail by a second runner block, and a fourth end part of the scissors mechanism is rotatably fixed to the first surface of said second part.

6. The hoisting device as claimed in claim 1, wherein at least one electrical wire is arranged between the first part and the second part, the electrical wire being fastened to the scissors mechanism.

* * * * *